United States Patent [19]

Yamaoka et al.

[11] 4,391,008

[45] Jul. 5, 1983

[54] ELEMENTS FOR ASSEMBLY OF KNOCKED-DOWN WATERBED PEDESTAL

[76] Inventors: Don N. Yamaoka; David L. Yamaoka, both of 13599 Desmond, Pacoima, Calif. 91331

[21] Appl. No.: 243,844

[22] Filed: Mar. 16, 1981

Related U.S. Application Data

[63] Continuation-in-part of Ser. No. 173,666, Jul. 29, 1980, abandoned.

[51] Int. Cl.[3] ..... A47C 19/00

[52] U.S. Cl. ..... 5/200 R; 5/200 C; 5/282 R; 5/285; 5/308

[58] Field of Search ..... 5/200 R, 200 C, 282 R, 5/283, 285, 290, 58, 308; 312/330 R, 111

[56] References Cited

U.S. PATENT DOCUMENTS

| | | | |
|---|---|---|---|
| 443,271 | 12/1890 | Dumas | 312/330 R |
| 2,825,101 | 3/1958 | Rubenstein | 312/111 |
| 3,542,447 | 11/1970 | Himelreich | 312/330 R |
| 3,680,177 | 8/1972 | Ginsberg | 312/330 R X |
| 3,752,553 | 8/1973 | Bildahl et al. | 312/330 R |
| 4,012,090 | 3/1977 | Pfeifer et al. | 312/330 R |
| 4,110,854 | 9/1978 | Sjolie | 5/58 X |

FOREIGN PATENT DOCUMENTS

| | | | |
|---|---|---|---|
| 517423 | of 1955 | Italy | 5/308 |

*Primary Examiner*—Ramon S. Britts
*Assistant Examiner*—Michael F. Trettel
*Attorney, Agent, or Firm*—Erik M. Arnhem

[57] ABSTRACT

A waterbed pedestal assembly, comprising a framework with front, back and sides, having openings in the front and back thereof for insertion of drawers there through; U-shaped brackets mounted to the interior of the front and back of the framework, into which a first set of dividers is inserted; additional U-shaped brackets mounted to the interior of the sides of the framework and to the first set of dividers; and a second set of dividers inserted therein perpendicularly to the first set of dividers; the back and the end portions of the sides of the drawers are dovetailed loosely fitting so as to create a cavity between side surfaces of dovetail and dovetail slots within which an elongated sliver is pressure fitted.

3 Claims, 5 Drawing Figures

FIG. 1
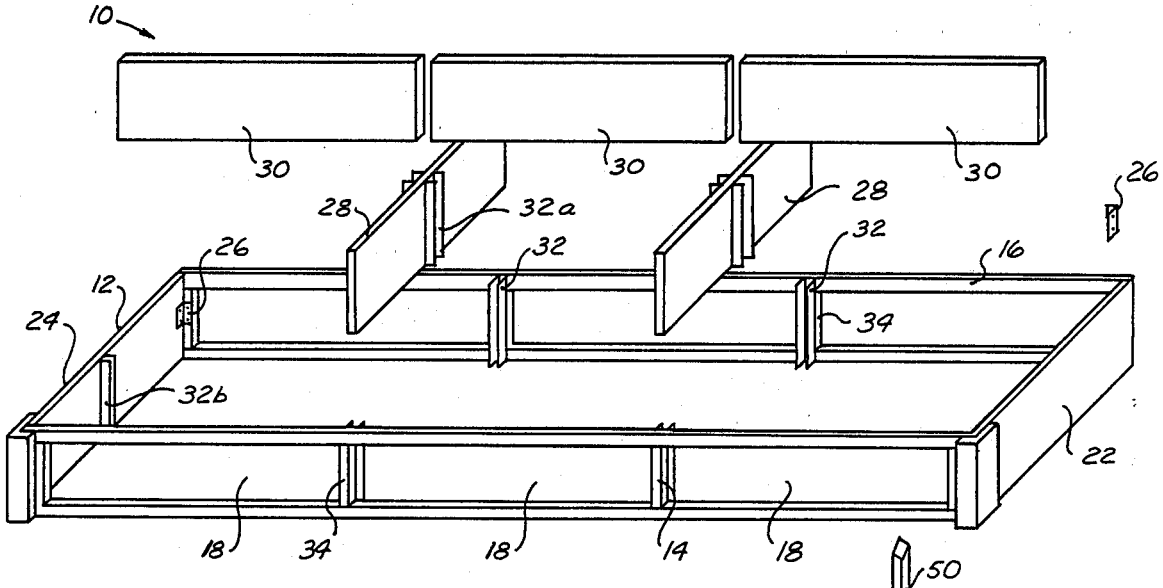
FIG. 3
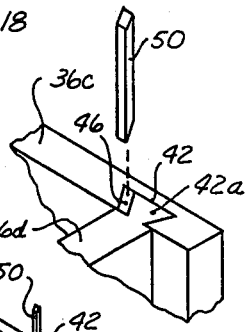
FIG. 2
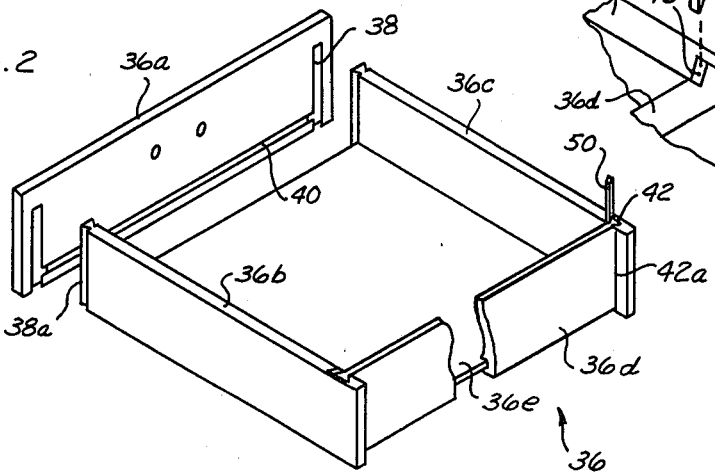
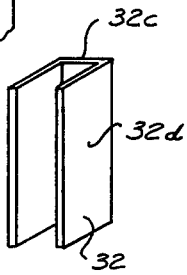
FIG. 4
FIG. 5
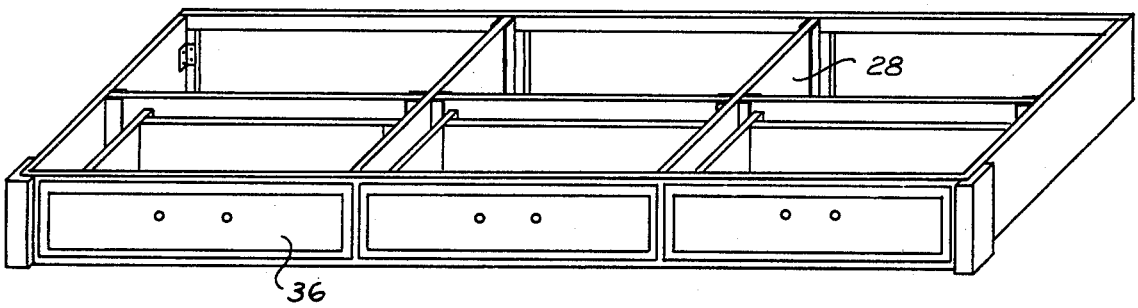

ELEMENTS FOR ASSEMBLY OF KNOCKED-DOWN WATERBED PEDESTAL

CROSS REFERENCES TO RELATED APPLICATIONS

This application is a continuation-in-part of parent application S.N. 173,666 filed July 29, 1980 in the U.S. Patent and Trademark Office, now abandoned.

FIELD OF THE INVENTION

Background of the invention.

Our invention concerns the assembly of exterior framework, dividers therewithin and drawers, constituting a pedestal for a waterbed. Prior to its assembly, the pedestal, according to the invention, basically constitutes flat pieces of boards, frames, etc., which may be shipped compactly in cartons, for subsequent assembly, virtually without the use of screws, nails, etc.

The waterbed industry has long been confronted with problems of how to ship such knocked-down pedestals for quick and secure assembly at the customer's home, especially when the latter does not have the patience or is not skilled enough to follow lengthy instructions of assemblying the pedestal.

SUMMARY OF THE INVENTION

In addition to what is stated under (d) above, our invention utilizes two novel elements, usable separately, or in combination with each other, particularly for assembly of waterbed pedestals, which, when applied properly therein will enable one to mount space dividers in the framework of the pedestal and join fronts, backs, sides and bottoms of drawers, inserted slidable between the dividers, by the mere use of slight manual pressure, as will be explained in greater detail in the following.

Thus, the tedious work of gluing, nailing, etc., the various board and panel sections, which constitutes the interior of the waterbed pedestal, is virtually eliminated.

It is, therefore a primary object of the invention to provide a waterbed pedestal, which from a knocked-down state may easily and securely be assembled, essentially without use of cumbersome means, such as nails, screws and glue, that may damage the material of the pedestal and also prevent quick disassembly of same, when required.

It is a further object of the invention to provide such a waterbed pedestal which, when knocked-down, is capable of being shipped in relatively flat boxes.

Additional advantages and objects of the invention will appear from the description of same herein.

BRIEF DESCRIPTION OF THE DRAWINGS

FIG. 1 is an exploded perspective view of the waterbed pedestal framework with dividers, according to the invention.

FIG. 2 is an exploded perspective view of one of the drawers of the waterbed pedestal.

FIG. 3 is an enlarged perspective view of a pressure fitted element, applicable onto the joining corner of sides and back of the drawer.

FIG. 4 is an enlarged perspective view of an elongated U-shaped flange element to fixedly accommodate the dividers of the pedestal.

FIG. 5 illustrates the assembled waterbed pedestal.

DESCRIPTION OF THE INVENTION

Like reference numerals in the different views of the drawings designate similar parts of the waterbed pedestal, according to the invention.

Numeral 10 designates the waterbed pedestal in its entirety.

The framework 12 is composed of a front and back portion 14, 16, respectively, having three rectangular openings 18 and two sides 22, 24, which are held securely together by means of four conventional brackets or angle irons 26 (as it is being indicated in FIG. 1).

Framework 12 is then, divided into six spaces by means of two sets of dividers 28, 30, respectively, extending, when fitted within framework 12, perpendicular to each other, so as to form rectangular spaces of equal size therein.

One of the novel elements used in connection with the assembly of the waterbed pedestal 10 constitutes secure receiving and holding means for the dividers 28, 30 to be inserted therein, e.g., an elongated U-shaped bracket 32, comprising base **32*c* and wings 32*d* (FIG. 4) preferably made of a plastic material; four such U-shaped brackets 32 are fastened, e.g., by means of stapling (not indicated in the drawings), with the back of their base 32*c*, respectively abutting the interior surface of the two sets of wooden strips 34; the latter divides, respectively front and back 14, 16 of framework 12 into the six rectangular openings 18. Two lengthwise extending dividers 28 are slidingly inserted from above (FIG. 1) into brackets 32 behind strips 34**.

Two additional brackets **32*a*, similar to bracket 32, are stapled back-to-back along the center line of each board 28; one further bracket 32*b* is stapled to the interior center line of sides 22, 24, respectively of framework 12**.

Three boards 30, are then being slidingly inserted, respectively, from above—perpendicular to boards 28—into and between a set of oppositely situated brackets **32*a* (board 28) and 32*b* (sides 22, 24), and thus complete the division of framework 12 into six equally sized spaces, within which drawers 36 are inserted through openings 18 in front portion 14 (or back 16) of the framework 12, into the pedestal 10**.

The space between the wings or flanges **32*d* of brackets 32, 32*a* and 32*b* incline slightly towards each other, so as to increase the clamping or compressive effect of same, when a divider (28–30) is received therewithin (FIG. 4**).

Drawers 36 includes front **36*a*, sides 36*b, c*, back 36*d* and bottom 36*e***.

The front portion **36*a* is, in a conventional manner, provided with vertical dovetail slots 38, into which dovetailed edges 38*a* of sides 36*b, c***, are frictionally fitted.

A lower interior portion of front portion **36*a* and sides 36*b, c*, are, in a conventional manner, provided with horizontal grooves 40 (one of which is seen on front 36*a*, FIG. 2); said grooves extend in alignment of one another when front and sides are assembled so as to form one continuous rectangular groove within which bottom 36*e* may be slidingly fitted from behind (prior to mounting back 36*d*). One additional vertical dovetail slot 42 extends continuously adjacent and parallel to the rear interior end of sides 36*b* and 36*c*, respectively, into which fits the dovetail 42*a* of back 36*d***.

However, it is not technically feasible to tightly dovetail the lateral ends of back **36*d*** into dovetail slots 42, once bottom 36*e* has been fitted within groove lengths 40. The lateral ends of back 36*d* is, therefore so constituted, that they may be first slid loosely into dovetail slots 42, as the initial step in securing the back 36*d* of drawer 36.

In FIG. 3 of the drawing, enlarged portions of the especially constituted single dovetail slot 42, and dovetail 42*a*, respectively of sides 36*b*, *c* and back 36*d* are illustrated.

As it appears from FIG. 3, dovetail 42*a* is undersized relative to dovetail slot 42, slthough their angular ratio remains substantially the same as in the case of the conventionally tight fitting dovetail joint.

When a tapering side surface of undersized dovetail 42*a* is caused to abut that tapering interior side surface of dovetail slot 42, which is disposed adjacent the end of side 36*b*, (c) (as shown in FIG. 3) a tapering cavity 46 will form between the oppositely situated tapering side surface of dovetail slot 42 and dovetail 42*a*, extending along the entire length of the joint, i.e., the height of sides 36*b*, *c* and back 36*d* of drawer 36, respectively.

The normal angle of the dovetail joint is 5/16 of an inch in from the edge for every inch of depth. This comes out to about a 14 degree angle.

The widest surface of dovetail slot 42 and dovetail 42*a* is, respectively $\frac{5}{8}''$ and $\frac{1}{2}''$.

An elongated insert means, for example sliver 50 conforming to a taper of 14 degrees, i.e., substantially corresponding to that of cavity 46 created by the undersized dovetail 42*a*, and having a width of $\frac{1}{4}''$, a thickness of $\frac{1}{8}''$ and the height of back 36*d*, is then pressure fitted into cavity 46, preferably by hand, adjacent the interior angular converging points (FIG. 3) of back 36*d*, and 36*b* (*c*) of the drawer. When sliver 50 is so inserted, its lower end will abut the bottom 36*e* of drawer 36, and cannot slide or move further downwardly. Sliver 50 thus establishes in a simple manner a rigid and lasting joining of back 36*d* and sides 36*b*, *c*, which heretofore had to be secured by gluing, nailing or other cumbersome means.

Sliver 50, preferably is made of hard plastic, such as acrylic or other appropriate material.

The assembly of the drawers, as described herein may, obviously be utilized in any piece of furniture or structure and thus is not limited to the use in waterbed pedestals.

In addition to the above stated dimensions, the dimensions, preferably chosen for elements 32, so that they will frictionally and securely receive and retain the ends of dividers 28 ($\frac{1}{2}''\times 9\frac{1}{4}\times 70\frac{1}{2}$) and 30 ($\frac{1}{2}''\times 24$) are as follows:

Height: $9\frac{1}{4}''$

Internal width between wings 32*d* of U-shaped bracket 32: approximately $\frac{3}{4}''$ Width of wing 32*d*: $\frac{3}{4}''$ The smoothly fitting and utilization of drawers, generally require the mounting of rails extending perpendicularly to and between the front 14 (or back 16) and divider (30) along the moving spaces for the drawers, and wheels mounted on the latter for running on the rails.

For the sake of clarity, the rails and wheels, being conventional standard components of drawers, are not shown in the drawings.

While the foregoing has illustrated and described what is now contemplated to be the best mode of carrying out the invention, the above embodiments thereof, in particular the dimensions, numbers and shapes of holding elements (32, 50), drawers (36) and dividers (28, 30) are subject to such modifications that fall within the scope of the appended claims, without departing from the spirit and scope of the invention.

We claim:

1. A drawer usable in a waterbed pedestal, comprising in combination:

(a) a front section, having dovetailed slots at its respective ends and a groove extending continuously horizontal along its lower portion;

(b) side sections, the front ends of which dovetails, fitting tightly into the slots of the front section, and grooves extending continuously horizontal along the lower portions thereof, the rear ends of the side sections being provided, respectively, with dovetail slots;

(c) a bottom section fitting slidingly into the grooves of the front and side sections;

(d) a back section, the ends of which have undersized dovetails fitting loosely within the dovetail slots of the rear end portions of the side sections, respectively, so as to create an elongated tapered cavity therewithin;

(e) elongated insert means adapted, respectively to be pressure fitted within the cavity in the dovetail joints of the end portions of the back and side sections, so as to establish rigid joining of the back and side section of the drawers, respectively.

2. A drawer, according to claim 1, wherein the insert means, are pressure fitted within the cavity of the dovetail slot of the side sections respectively, having an angular taper of 14 degrees created between the inner side surface of the dovetailed back and dovetailed slotted sides of the drawers, adjacent the interior angular converging joints thereof.

3. A drawer, according to claim 2, wherein the insert means is an elongated sliver, conforming to the taper of the cavity of the dovetail slot of the side sections, having a width of $\frac{1}{4}$ of an inch, a thickness of $\frac{1}{8}$ of an inch and height corresponding to that of the back of the drawer.

* * * * *